US008636372B2

(12) United States Patent
Reinhard-Herrscher et al.

(10) Patent No.: US 8,636,372 B2
(45) Date of Patent: Jan. 28, 2014

(54) COOKING OVEN WITH AN ILLUMINATION-EQUIPMENT FOR A CAVITY AND A METHOD FOR ILLUMINATING A CAVITY OF A COOKING DEVICE

(75) Inventors: Fabienne Reinhard-Herrscher, Kirchberg/Jagst (DE); Klaus Winkelmann, Gedem (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 446 days.

(21) Appl. No.: 12/989,277

(22) PCT Filed: May 12, 2009

(86) PCT No.: PCT/EP2009/003337
§ 371 (c)(1),
(2), (4) Date: Oct. 22, 2010

(87) PCT Pub. No.: WO2009/141068
PCT Pub. Date: Nov. 26, 2009

(65) Prior Publication Data

US 2011/0049121 A1 Mar. 3, 2011

(30) Foreign Application Priority Data

May 17, 2008 (EP) ..... 08009170

(51) Int. Cl.
*F27D 21/02* (2006.01)

(52) U.S. Cl.
USPC ..... 362/92; 219/220; 362/23.08; 362/234; 362/249.02

(58) Field of Classification Search
USPC ..... 126/19 R, 273 R; 219/220; 362/23.07, 362/23.08, 92, 96, 231, 234, 249.02
See application file for complete search history.

(56) References Cited

U.S. PATENT DOCUMENTS

| | | | | |
|---|---|---|---|---|
| 4,129,769 | A | 12/1978 | Takagi et al. | |
| 5,287,253 | A * | 2/1994 | Blorstad | 362/92 |
| 5,747,783 | A * | 5/1998 | Myung et al. | 362/92 |
| 2005/0259931 | A1 * | 11/2005 | Gaydoul et al. | 385/116 |

FOREIGN PATENT DOCUMENTS

| | | |
|---|---|---|
| DE | 10340879 | 3/2005 |
| DE | 202005012027 | 11/2006 |
| EP | 1995522 | 11/2008 |

OTHER PUBLICATIONS

International Search Report for PCT/EP2009/003337, dated Sep. 28, 2009, 3 pages.

* cited by examiner

*Primary Examiner* — Stephen F Husar
(74) *Attorney, Agent, or Firm* — Pearne & Gordon LLP

(57) ABSTRACT

The present invention relates to a cooking oven with at least one cavity (12) and an illumination-equipment (e.g. a LED-lamp) for illuminating said cavity (12). The illumination-equipment, comprises a plurality of light emitting elements (30) for illuminating the cavity (12). The light emitting elements (30) have at least two different colors. Single light emitting elements (30) and/or groups of light emitting elements (30) are separately controlled or controllable. The color or a combination of colors of the light emitting elements (30) is provided to indicate information about an operation mode of the cooking oven and/or a state of the cooking process. The light emitting elements (30) and/or groups of light emitting elements (30) are arranged at multiple positions within the cavity (12) in order to indicate information related to said positions. Further, the present invention relates to a method for illuminating a cavity (12) of a cooking oven.

14 Claims, 2 Drawing Sheets

Figure 1:
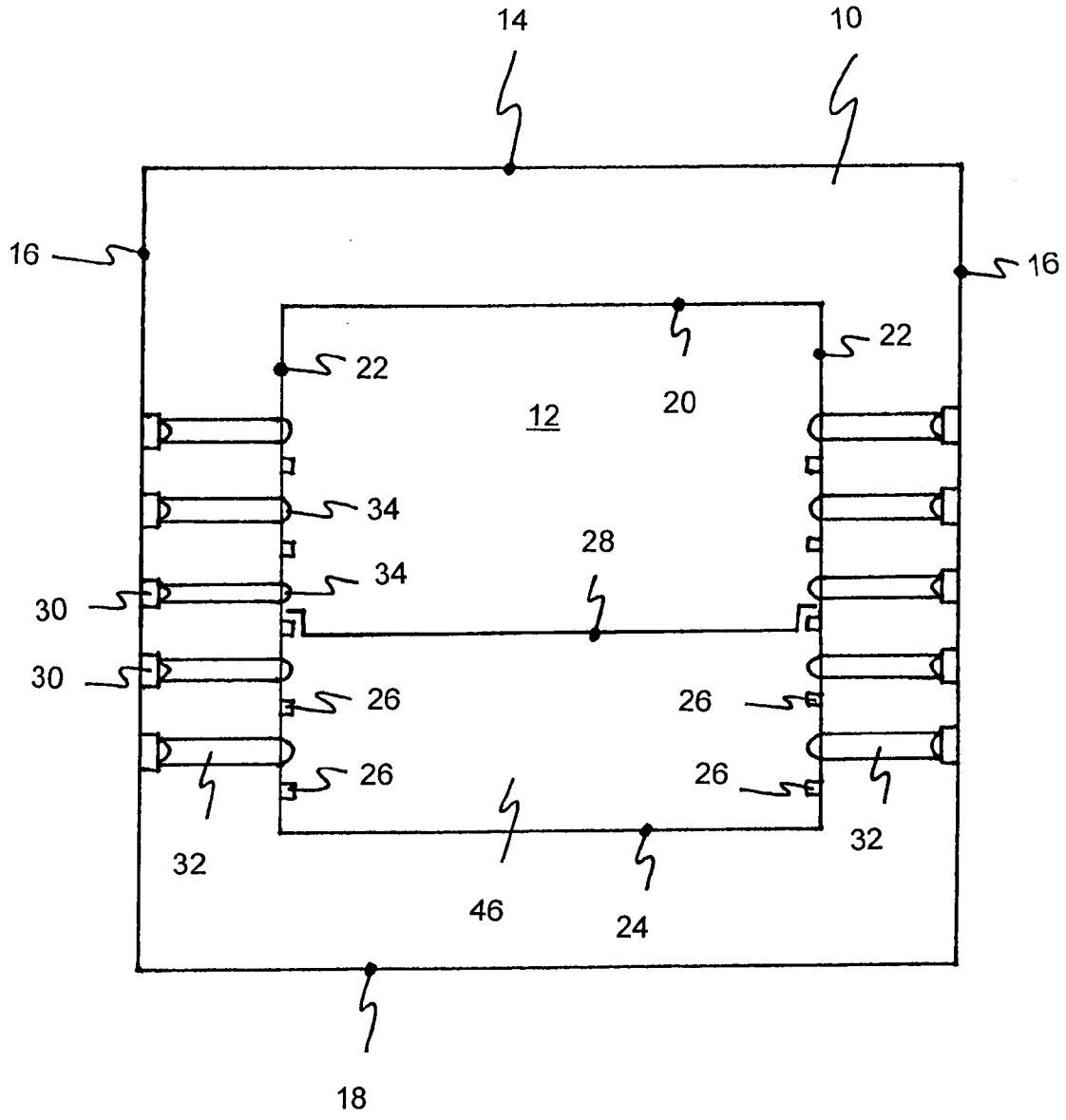

COOKING OVEN WITH AN ILLUMINATION-EQUIPMENT FOR A CAVITY AND A METHOD FOR ILLUMINATING A CAVITY OF A COOKING DEVICE

The present invention relates to a cooking oven with an illumination-equipment according to the preamble of claim 1. Further, the present invention relates to a method for illuminating a cavity of a cooking oven according to the preamble of claim 13.

In a cooking oven a foodstuff is located in a cavity behind an oven door during a cooking process. Usually, the oven door includes a window, so that the user can observe the progression of the cooking process. During observing the cooking process the user must clearly see the foodstuff in the cavity from the outside of the cooking oven.

There are different types of light sources, like halogen bulbs or light emitting diodes, used within the cavity of the cooking oven. The light sources are arranged in various positions in the cavity, like the side walls, the rear wall or the top walls, in order to illuminate the cavity of the cooking oven.

In the most cases the illumination-equipment is just used for the illumination of the foodstuff in the cavity of the cooking oven.

The U.S. Pat. No. 5,747,783 describes a cooking chamber of a microwave oven. The colour of the illumination of the cooking chamber is changed in accordance with the progress of the cooking operation. Thus, the user is able to observe the progress of the cooking operation from a distance.

It is an object of the present invention to provide a cooking oven with an illumination-equipment, wherein said illumination-equipment gives extended information about the cooking oven and/or the cooking process. It is further an object of the present invention to provide a method for illuminating a cavity of a cooking oven, wherein the said resulting illumination gives extended information about the cooking oven and/or the cooking process.

This object of the present invention is achieved by the cooking oven according to claim 1.

According to the present invention the light emitting elements and/or groups of light emitting elements are arranged at multiple positions within the cavity in order to indicate information related to said positions.

The main idea of the present invention is the arrangement of light emitting elements with at least two different colours at multiple positions within the cavity. The colour or the combination of colours may be associated with the temperature in the cavity, the operation mode of the cooking oven or the progress of the cooking operation and other characteristics. Additionally, the multiple positions of the light emitting elements allow the representation of further information. Thus, the illumination equipment of the present invention provides a higher content of information about the cooking oven and the cooking process.

Preferably, the light emitting element is a light emitting diode (LED). The light emitting diode is very small and has low energy consumption.

Further, at least one pair of light emitting elements has complementary colours, so that an equal combination of light emitting elements with said complementary colours leads to a white light. This constellation allows three resulting colours by only two light emitting elements. The light emitting elements with the complementary colours can be separately activated. The activation of both light emitting elements with the complementary colours provides the white light.

Alternatively or additionally, the light emitting elements have at least three different basic colours, in particular red, blue and green, wherein three basic colours are defined in such a way, that an equal combination of light emitting elements with said three basic colours leads to a white light.

Additionally, the illumination-equipment may comprise at least one light emitting element for emitting white light. This allows a white light with a very high intensity.

In a special embodiment at least a part of the light emitting elements are associated with different levels of side grids. For example, the light emitting element is provided to indicate a preferred or proper level of side grids. In this case the user may be informed about an ideal side grid before inserting a tray or a grid into the cavity on said side grid.

Further, a certain colour or combination of colours is associated with a temperature range in order to indicate an instantaneous temperature. In a similar way, a certain colour or combination of colours may be associated with a cold cavity.

In another feature of the invention a certain colour or combination of colours may be associated with a preheating process. In the same way, a certain colour or combination of colours may be associated with a pyrolysis process.

According to a further embodiment of the invention, the cooking oven comprises a fan with a propeller, wherein said propeller is arranged within the cavity. At least one light emitting element may be arranged at a propeller blade of the propeller. Alternatively or additionally, at least one lighting element may be arranged behind the propeller.

Preferably, light emitting elements with different colours are arranged at different propeller blades of the propeller. This allows a very efficient combination of different colours, so that the resulting colour looks homogenously.

For example, a certain colour or combination of colours is associated with the activated fan. This is especially advantageous, if the fan is quiet.

This object of the present invention is further achieved by the method according to claim 13.

According to the present invention the light emitting elements and/or groups of light emitting elements are arranged at multiple positions within the cavity for indicating information related to said positions.

The main idea of the inventive method is the arranging of light emitting elements with at least three different colours at multiple positions within the cavity. The colour or the combination of colours is associated with the temperature in the cavity, the operation mode of the cooking oven or the progress of the cooking operation and other characteristics. Additionally, the multiple positions of the light emitting elements allow the representation of further information. Thus, the method of the present invention provides a higher content of information about the cooking oven and the cooking process.

Further, at least two complementary colours are provided, so that their equal combination results in a white light.

Alternatively or additionally, three basic colours are provided, so that their equal combination results in a white light. For example, the basic colours red, blue and green are provided.

Additionally, at least one light emitting element for emitting white light may be provided. This allows the generation of white light with high intensity.

Further, at least a part of the light emitting elements may be associated with different levels of side grids. In this case, a preferred or proper level of the side grids may be indicated.

For example, a certain colour or combination of colours may be associated with a temperature range in order to indicate an instantaneous temperature.

At last, a certain colour or combination of colours may be associated with a cold cavity, a preheating process, a pyrolysis process and/or an activated fan.

The novel and inventive features believed to be the characteristic of the present invention are set forth in the appended claims.

Figure 2:
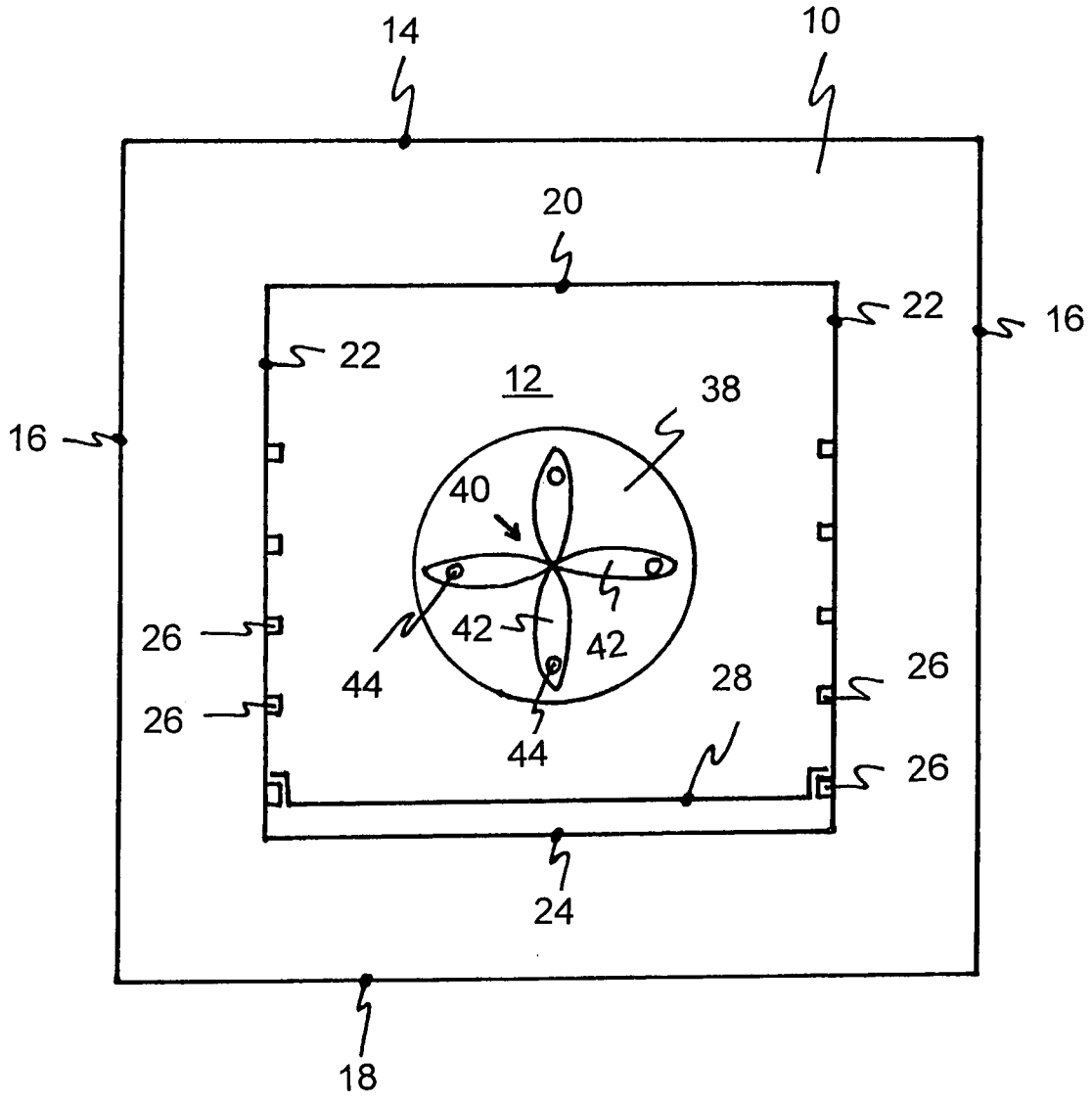

The invention will be described in further detail with reference to the drawing, in which FIG. 1 illustrates a schematic diagram of a sectional front view of a cooking oven according to a first embodiment of the present invention, and FIG. 2 illustrates a schematic diagram of a sectional front view of the cooking oven according to a second embodiment of the present invention.

FIG. 1 illustrates a schematic diagram of a sectional front view of the cooking oven according to a first embodiment of the present invention. The cooking oven comprises a casing 10 and a cavity 12. The casing 10 is formed by an outer top wall 14, outer side walls 16 and an outer bottom wall 18. The cavity 12 is formed by an inner top wall 20, inner side walls 22 and an inner bottom wall 24.

A number of side grids 26 are pair-wise arranged on the inner sides of the inner side walls 22. The side grids 26 of each pair are arranged at the same level. The side grids 26 extend horizontally along the inner sides of the inner side walls 22. The pair of side grids 26 is provided to support a tray 28 or a grid.

The outer walls 14, 16, 18 and the adjoining inner walls 20, 22, 24 are arranged plane-parallel, respectively. Between the inner side walls 22 and the adjoining outer side walls 22 a plurality of light emitting elements 30 is arranged. The light emitting elements 30 are arranged on the inner side of the outer side walls 16. The light beams from the light emitting elements 30 are substantially directed at the adjoining inner side walls 22. Preferably, the light emitting element 30 is realized by a light emitting diode (LED).

Each of the light emitting elements 30 corresponds with an elongated light guide element 32. The light guide element 32 extends from the corresponding light emitting element 30 to an opening in the inner side wall 22. The light guide element 32 extends substantially perpendicular to the plane of the inner side wall 22. The light guide element 32 may be a glass rod, which is preferably laminated or coated on its outside. Further, the light guide element 32 may be made of heat resistant plastics. In addition, the light guide element 32 may be a fibre optic light guide.

A lens 34 is arranged at the end of the light guide element 32. The lens 34 is in and/or in front of an opening in the inner side wall 22. In this example the lens 34 extends marginally into the cavity 12.

The light beam is generated by the light emitting element 30 and guided by the light guide element 32. Then the light beam is dispersed by the lens 34 in order to create a light cone within the cavity 12. Said light cone covers substantially the inner side wall 22 on the opposite side and the inner rear wall 46.

In this example there are five light emitting elements 30 at the outer side wall 16 on the left hand side as well as five light emitting elements 30 at the outer side wall 16 on the right hand side. Said five light emitting elements 30 and the corresponding light guide element 32 are arranged among each other. The light emitting elements 30 are arranged in a fore portion of the cavity 12, so that the light cone is directed to the inner rear wall 46 and the opposite inner side wall 22.

Each light emitting element 30, light guide element 32 and lens 34 are associated with one of the side grids 26. The light emitting element 30 with the light guide element 32 and lens 34 is arranged marginally above the corresponding side grid 26.

For example, the light emitting element 30 can be used to indicate the side grid 26, on which the tray 28 has to be inserted, if the oven door is open. In this case the light emitting element 30 at the same level is activated. The light emitting element 30 are controlled by an according circuit and/or program. The control of the light emitting element 30 may depend on stored information about the kind and the size of the foodstuff. Said information may be input by the user in the beginning of the cooking process.

The light emitted by the light emitting elements 30 has various colours. Preferably, the cooking oven comprises three kinds of light emitting elements 30. Said light emitting elements 30 have the basic colours red, blue and green. Further colours may be generated by an activation of two different light emitting elements 30. By an equal combination of the basic colours red, blue and green a white light may be generated. In particular, the white light may be used to illuminate the foodstuff in a normal operation. The white light allows the user to observe the foodstuff very well.

In a further embodiment, the cooking oven comprises four kinds of light emitting elements 30. Said light emitting elements 30 have the three basic colours red, blue and green and additionally white. This constellation allows the generation of white light with a high intensity.

The colours of the light inside the cavity may be associated with the temperature in the cavity, the operation mode of the cooking oven, the progress of the cooking operation and other characteristics related to the cooking oven or cooking process.

In an alternative embodiment, instead of the five light emitting elements 30 at each outer side wall 16 in FIG. 1, only two or three light emitting elements 30 can be arranged at each outer side wall 16. Said two or three light emitting elements 30 may be combined with additional one or more light emitting elements at the inner top wall 11 or the outer top wall 11.

FIG. 2 illustrates a schematic diagram of a sectional front view of the cooking oven according to a second embodiment of the present invention. The cooking oven comprises also the casing 10 and the cavity 12. The casing 10 is formed by the outer top wall 14, the both outer side walls 16 and the outer bottom wall 18. The cavity 12 is formed by the inner top wall 20, the both inner side walls 22 and the inner bottom wall 24.

The number of side grids 26 is arranged pair-wise on the inner sides of the inner side walls 22. Both side grids 26 of each pair are also arranged at the same level. The side grids 26 extend horizontally along the inner sides of the inner side walls 22. The pair of side grids 26 is provided to support the tray 28 or the grid.

In a rear wall of the cavity 12 there is a fan 38. The fan 38 comprises a propeller 40 with a number of propeller blades 42. In this example, the propeller 40 comprises four propeller blades 42. The axis of the propeller 40 extends perpendicular to the plane of the drawing. On an outer portion of each propeller blade 42 there is a light emitting element 44. The light emitting elements 44 may also arranged behind the propeller 40.

For example, the light emitting element 44 may indicate that the fan 38 is activated. The colour or the combination of colours of the light emitting elements 44 may be associated with the velocity of the propeller 40. Further, the colour or the combination of colours of the light emitting elements 44 may be associated with the temperature of the air exhausted by the fan 38.

In general, the colours of the light emitting elements 44 may be associated with the temperature in the cavity, the operation mode of the cooking oven, the progress of the cooking operation and other characteristics related to the cooking oven or cooking process.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 casing
12 cavity
14 outer top wall
16 outer side wall
18 outer bottom wall
20 inner top wall
22 inner side wall
24 inner bottom wall
26 side grid
28 tray
30 light emitting element
32 light guide element
34 lens
36 opening
38 fan
40 propeller
42 propeller blade
44 light emitting element

The invention claimed is:

1. A cooking oven with a cavity (12) and an illumination-equipment for illuminating said cavity (12), wherein: —the illumination-equipment comprises a plurality of light emitting elements (30) for illuminating the cavity (12), the light emitting elements (30) having at least two different colours, —the plurality of light emitting elements (30) being arranged as individual light emitting elements (30), groups of individual light emitting elements (30), or a combination of individual light elements (30) and groups of individual lighting elements (30) separately controlled or controllable, and the colour or a combination of colours of the light emitting elements (30) are provided to indicate information about at least one of an operation mode of the cooking oven and a state of the cooking process, characterized in, that the individual light emitting elements (30), the groups of individual light emitting elements (30) or the individual light emitting elements (30) and the groups of individual light emitting elements (30) are arranged at multiple different positions within the cavity (12) in order to independently indicate different information specific to each of said different positions.

2. The cooking oven according to claim 1, characterized in, that at least one pair of light emitting elements included in the plurality of light emitting elements (30) has complementary colours, so that an equal combination of each light emitting element included in the at least one pair of light emitting elements (30) leads to a white light.

3. The cooking oven according to claim 1, characterized in, that the light emitting elements (30) have at least three different basic colours, in particular red, blue and green, wherein three basic colours are defined in such a way, that an equal combination of light emitting elements (30) with said three basic colours leads to a white light.

4. The cooking oven according to claim 1, characterized in, that the illumination-equipment comprises at least one light emitting element (30) for emitting white light.

5. The cooking oven according to claim 1, characterized in, that at least a part of the light emitting elements (30) is associated with different levels of side grids (26), wherein in particular the light emitting element (30) is provided to indicate a preferred or proper level of the side grids (26).

6. The cooking oven according to claim 1, characterized in, that a certain colour or combination of colours is associated with a temperature range in order to indicate at least one of: an instantaneous temperature that a certain colour or combination of colours is associated with a cold cavity (12), a preheating process, and a pyrolysis process.

7. The cooking oven according to, claim 1, characterized in, that the cooking oven comprises a fan (38) with a propeller (40) arranged within the cavity (12), wherein at least one light emitting element (30) is arranged at a propeller blade (42) of the propeller (40), behind the propeller (40), or at the propeller blade (42) of the propeller (4) and behind the propeller (40), wherein said at least one light emitting element (30) comprises a plurality of said light emitting elements (30), each with a different colour and being arranged at different propeller blades (42) of the propeller (40), behind the propeller (40), or at the different propeller blades (42) of the propeller (40) and behind the propeller (40), wherein a certain colour or combination of colours is associated with the activated fan (38).

8. A method for illuminating a cavity (12) of a cooking oven, wherein said method comprises the steps of: providing an illumination-equipment with a plurality of light emitting elements (30) with at least two different colours, separately controlling a single one of the plurality of light emitting elements (30), groups of individual light emitting elements (30) included in the plurality of light emitting elements (30), or the single one of the plurality of light emitting elements (30) and the groups of individual light emitting elements (30), and associating one of the at least two different colours or a combination of two or more of the at least two different colours of the light emitting elements (30) with an operation mode of the cooking oven, a state of the cooking process, or both the operation mode of the cooking oven and the state of the cooking process, characterized in, that the single one of the light emitting elements (30), the groups of individual light emitting elements (30), or the single one of the light emitting elements (30) and the groups of individual light emitting elements (30) are arranged at multiple different positions within the cavity (12) for independently indicating different information specific to each of said different positions.

9. The method according to claim 8, characterized in providing at least two complementary colours, so that their equal combination results in a white light, providing at least three basic colours, red, blue and green, so that their equal combination results in a white light, or both said providing the at least two complementary colours, so that their equal combination results in the white light and said providing the at least three basic colours red, blue and green, so that their equal combination results in the white light.

10. The method according to claim 8, characterized in providing at least one light emitting element (30) for emitting white light.

11. The method according to claim 8, characterized in, that associating at least a part of the light emitting elements (30) with different levels of side grids (26).

12. The method according to claim 11, characterized in, that indicating a preferred or proper level of the side grids (26).

13. The method according to claim 8, characterized in, that associating a certain colour or combination of colours with a temperature range in order to indicate an instantaneous temperature.

14. The method according to claim 8, characterized in, that associating a certain colour or combination of colours with a cold cavity (12), a preheating process, a pyrolysis process and/or an activated fan (38).

* * * * *